US006818847B1

(12) United States Patent
Huang

(10) Patent No.: US 6,818,847 B1
(45) Date of Patent: Nov. 16, 2004

(54) MODULATED BUTTON ASSEMBLY FOR AN OVERLOAD PROTECTION SWITCH

(76) Inventor: Albert Huang, 3F, No. 146, Sec. 4, Chungking N. Rd, Taipei (TW)

( * ) Notice: Subject to any disclaimer, the term of this patent is extended or adjusted under 35 U.S.C. 154(b) by 0 days.

(21) Appl. No.: 10/748,956

(22) Filed: Dec. 30, 2003

(51) Int. Cl.[7] ..... H01H 3/00
(52) U.S. Cl. ..... 200/339; 200/302.3
(58) Field of Search ..... 200/339, 293, 200/302.03, 303, 345, 520, 50.02, 50.01, 50.11, 50.36

(56) References Cited

U.S. PATENT DOCUMENTS 3,928,743 A * 12/1975 Ohashi ..... 200/308
5,336,861 A * 8/1994 Cummins et al. ..... 200/339

* cited by examiner

*Primary Examiner*—Elvin Enad
*Assistant Examiner*—Lisa Klaus
(74) *Attorney, Agent, or Firm*—Jackson Walker LLP

(57) ABSTRACT

A modulated button assembly has a button and a base. The base has a receiving space defined therein, two first through holes defined in a side face defining the receiving space to be receivable therein two bosses on one pair of the connecting plates, a second through hole defined in a side face relative to the side face having the two first through holes to be receivable therein one boss of the other pair of connecting plates and a push bar extending downward from a bottom of the base for engagement with a deformable metal plate received in the housing of the switch.

2 Claims, 4 Drawing Sheets

MODULATED BUTTON ASSEMBLY FOR AN OVERLOAD PROTECTION SWITCH

BACKGROUND OF THE INVENTION

1. Field of the Invention

The present invention relates to a modulated button assembly, and more particularly to a modulated button assembly for an overload protection switch so that with the same base, numerous different buttons are able to mate with the base to form a complete button assembly to reduce manufacture cost.

2. Description of Related Art

In order to prevent electrical appliance from overloading, a dual metal plate or the like is provided to the switch such that when the current passes through the switch is overloaded to cause the rise of the dual metal plate temperature, which will automatically cut off continuous power transmission to the electrical appliance and thus the electrical appliance is protected. Normally, the function of the dual metal plate is based on the heat expansion differences between the two metals of the plate and is securely received in the switch having a button assembly and a housing partially and pivotally receiving therein the button assembly. Because there are numerous different buttons available on the market, users will have to search for the suitable element to connect to the button chosen to allow the button assembly to be received in the housing, which is very troublesome and labor efficient. Furthermore, to mate with the different buttons, the manufacturers have to prepare different molds for making different bases for interconnecting the buttons and the housing of the switch. This is another drawback in which manufacture cost is increased.

To overcome the shortcomings, the present invention tends to provide an improved modulated button assembly to mitigate the aforementioned problems.

SUMMARY OF THE INVENTION

The primary objective of the present invention is to provide an improved modulated button assembly having a universal base for mating with different buttons so that the combination of the universal base is able to interconnect the buttons to the housing of a switch.

Another objective of the present invention is that the manufacture cost is dramatically decreased.

Other objects, advantages and novel features of the invention will become more apparent from the following detailed description when taken in conjunction with the accompanying drawings.

DETAILED DESCRIPTION OF THE PREFERRED EMBODIMENT

Figure 1:
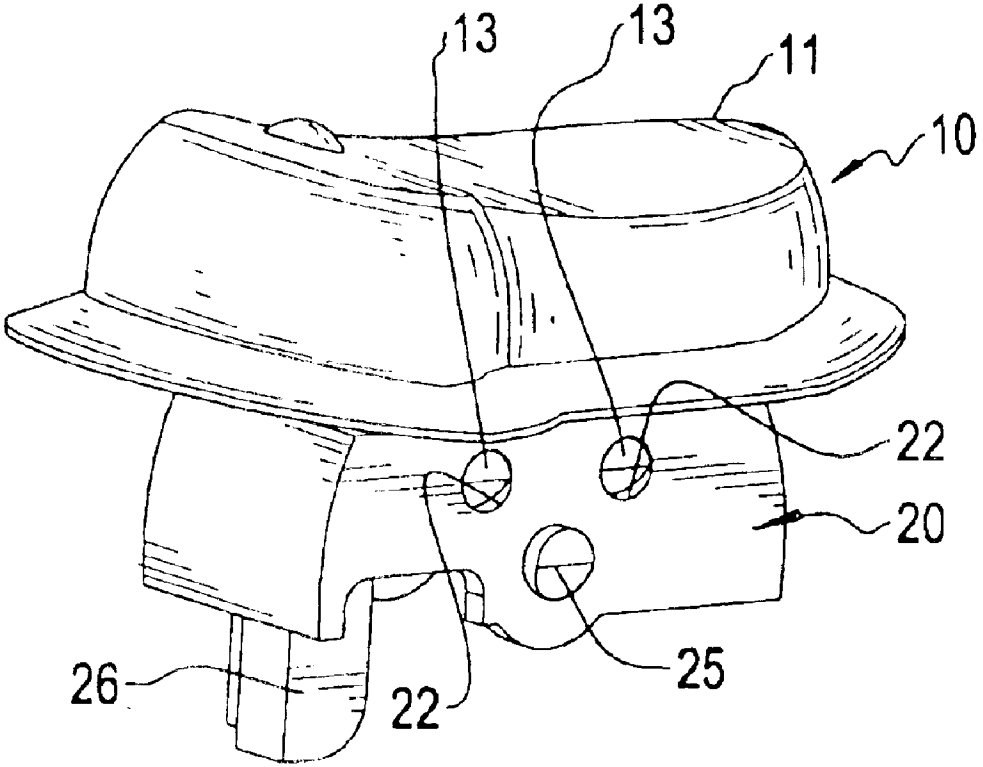
FIG. 1 is a perspective view of the button assembly of the present invention.
Figure 2:
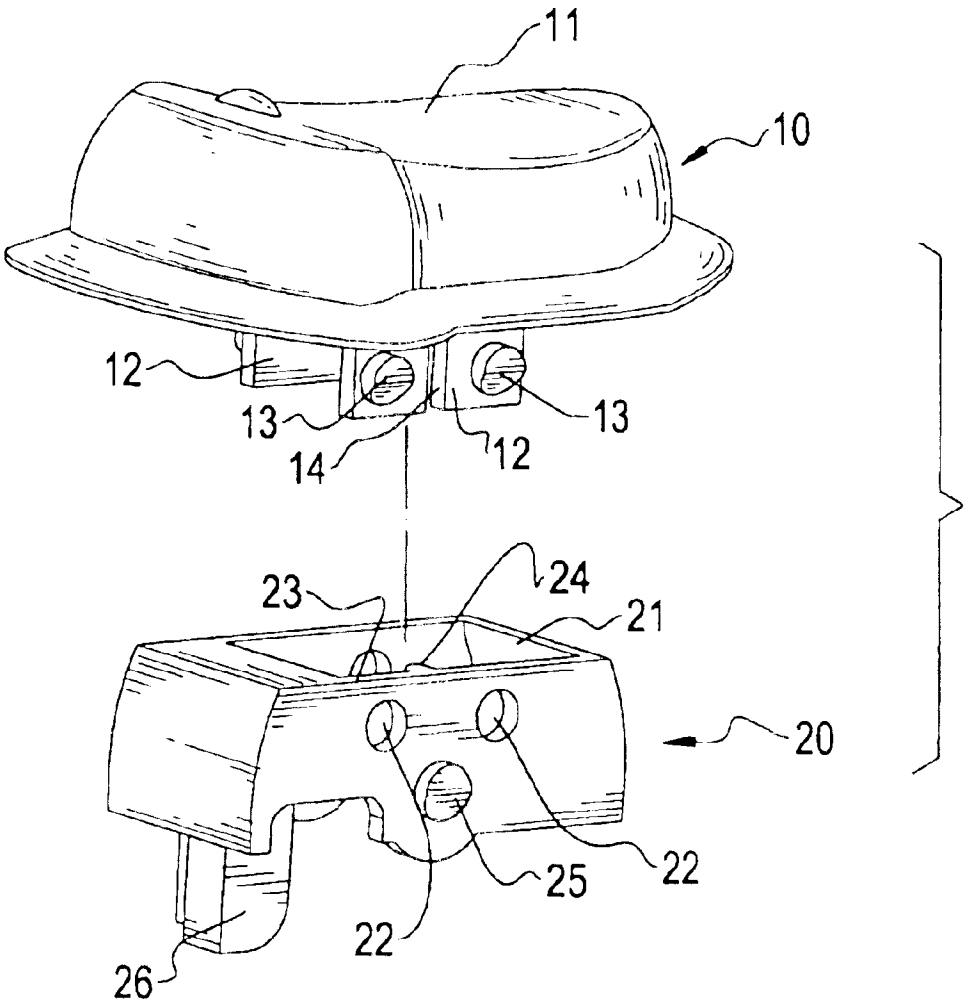
FIG. 2 is an exploded perspective view showing the base and the button mated with the base.

With reference to FIGS. 1 and 2, the modulated button assembly in accordance with the present invention includes a button (10) and a base (20).

The button (10) has a cap (11) and two pairs of connecting plates (12) oppositely extending downward from a bottom face of the cap (11). Each connecting plate (12) is provided with a boss (13) formed on the connecting plate (12). A gap (14) is defined between two adjacent connecting plates (12).

The base (20) has a receiving space (21) centrally defined in the base (20), two first through holes (22) defined in a side face defining the receiving space (21) to correspond to the two bosses (13) of one pair of the connecting plates (12) of the button (10), a second through hole (23) oppositely defined relative to the side face having the two first through holes (22) to correspond to one of the bosses (13) of the other pair of connecting plates (12), an extension (24) formed on the side face of the two first through holes (22) to correspond to the gap (14) of the button (10), a protrusion (25) formed on the side face having the two first through holes (22) and a push bar (26) extending downward from a bottom of the base (20). When the button assembly is to be assembled, the two bosses (13) from one pair of connecting plates (12) are inserted into the corresponding first through holes (22) and one boss (13) from the other pair of connecting plates (12) is inserted into the corresponding second through hole (13) to allow the extension (24) sandwiched between one pair of connecting plates (12) and received in the gap (14). Thus, the assembly of the button assembly is finished.

Figure 3:
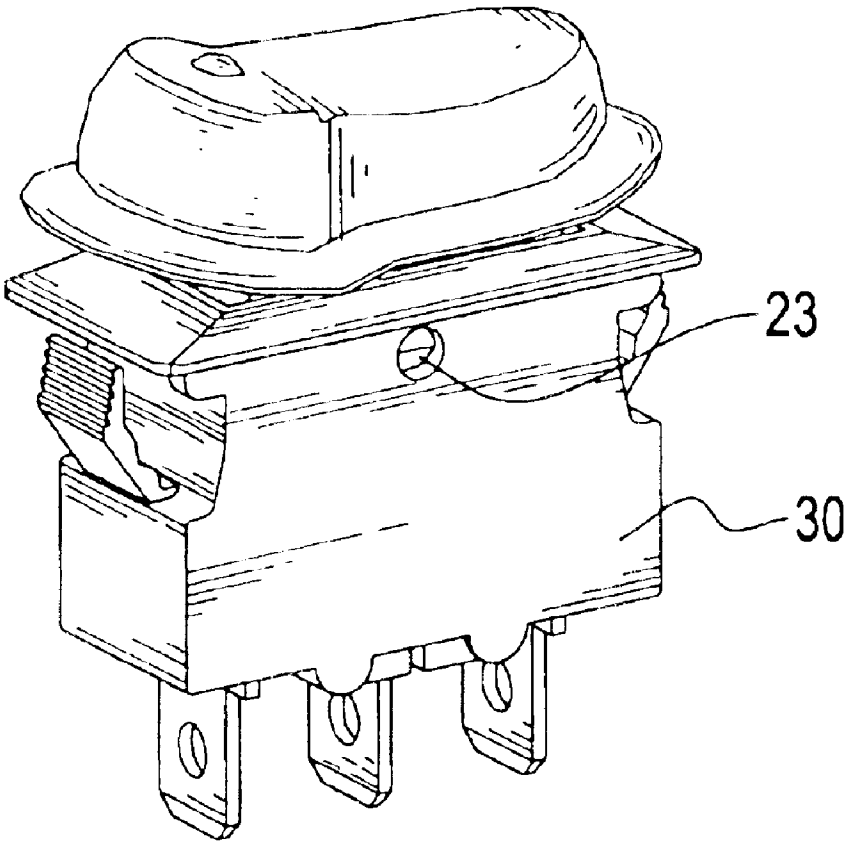
FIG. 3 is a perspective view showing that the button assembly is partially received in a housing of a switch.

With reference to FIG. 3, the button assembly is combined with the housing (30) to form a switch, wherein the push bar (26) is engageable with the dual metal plate (not shown) to be driven by the dual metal plate when the dual metal plate temperature is risen due to the load in the switch.

Figure 4:
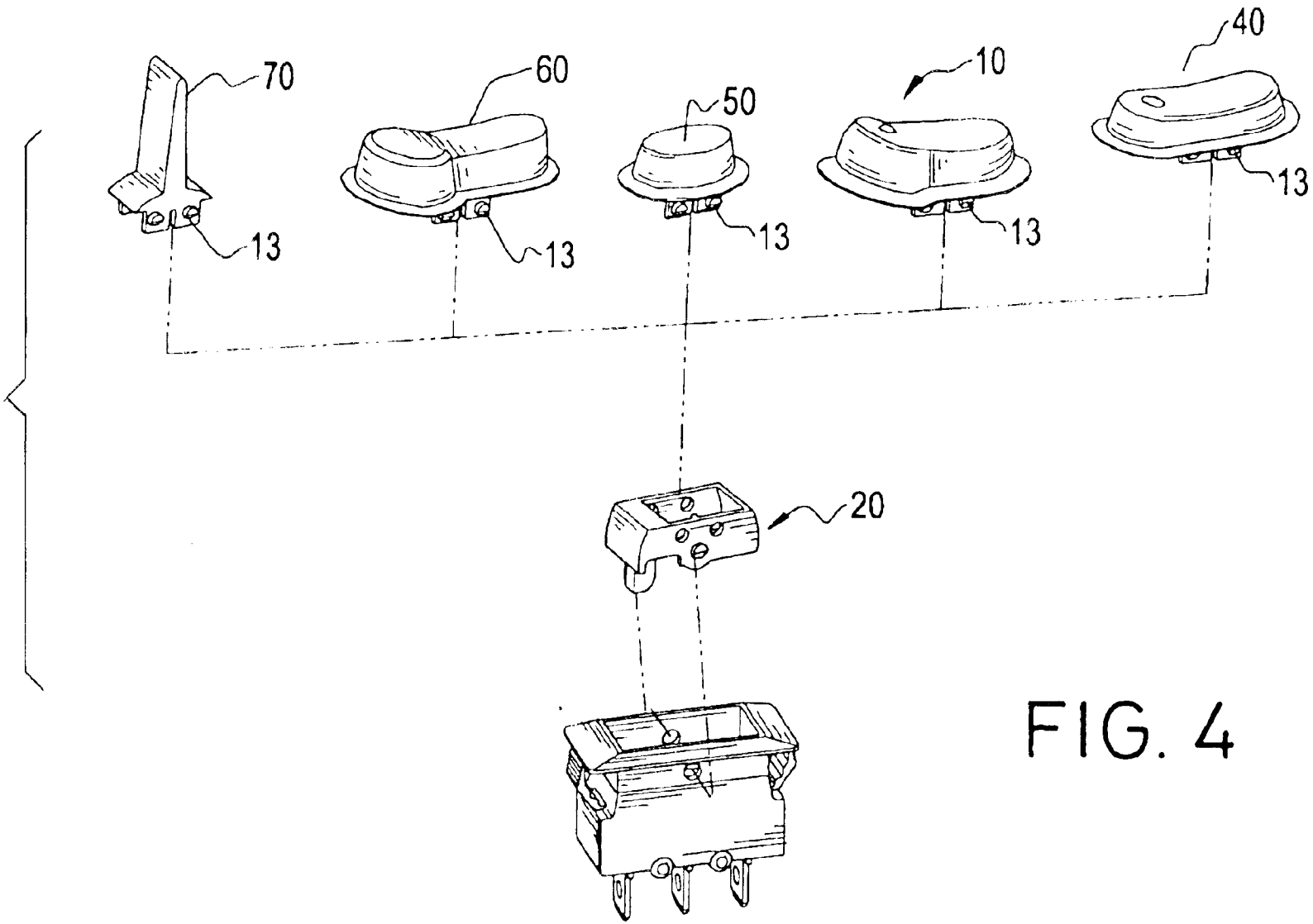
FIG. 4 is a schematic view showing that the base of the present invention is able to mate with different buttons.

With reference to FIG. 4, it is noted that no matter what kinds of the button (10,40,50,60,70) may be, the base (20) constructed in accordance with the present invention is able to mate with the button (10,40,50,60,70) to form a button assembly to match the housing so as to form a switch.

From the foregoing description, it is appreciated that the base (20) is able to mate with different kinds of buttons (10,40,50,60,70) to form a button assembly such that the manufacture cost for the button assembly is dramatically reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modulated button assembly adapted to connect to a housing of a switch, wherein the modulated button assembly has a base and a button provided with a cap and two pairs of connecting plates oppositely extending downward from a bottom face of the cap, wherein each connecting plate has a boss formed on the connecting plate and gap is defined between two adjacent connecting plates, wherein the improvement comprises:

the base has a receiving space defined therein, two first through holes defined in a side face defining the receiving space to be receivable therein two bosses on one pair of the connecting plates, a second through hole defined in a side face relative to the side face having the two first through holes to be receivable therein one boss of the other pair of connecting plates and a push bar extending downward from a bottom of the base for engagement with a deformable metal plate received in the housing of the switch.

2. The modulated button assembly as claimed in claim 1, wherein the base further has an extension formed in the receiving space to be receivable in the gap of the button to enhance interconnection therebetween.

* * * * *